United States Patent [19]

Zeier

[11] 4,057,918

[45] Nov. 15, 1977

[54] STEAM IRON

[76] Inventor: Hans Zeier, Beethovenstrasse 5, Zurich, Switzerland, 8002

[21] Appl. No.: 704,695

[22] Filed: July 12, 1976

[30] Foreign Application Priority Data

July 11, 1975 Germany ..... 2530926

[51] Int. Cl.[2] ..... D06F 25/06

[52] U.S. Cl. ..... 38/77.3; 38/77.83

[58] Field of Search ..... 38/77.83, 77.9, 77.1, 38/77.3, 77.6, 77.82, 93, 97

[56] References Cited

U.S. PATENT DOCUMENTS

| | | | |
|---|---|---|---|
| 2,637,126 | 5/1953 | Fitzsimmons | 38/77.83 |
| 3,142,916 | 8/1964 | Jacobson | 38/97 |
| 3,413,741 | 12/1968 | Schwartz et al. | 38/77.83 |
| 3,609,890 | 10/1971 | Abraham | 38/77.83 |
| 3,694,942 | 10/1972 | Vondracek et al. | 38/77.83 |

*Primary Examiner*—Patrick D. Lawson
*Attorney, Agent, or Firm*—Karl F. Ross

[57] ABSTRACT

A steam iron with an electrically heated sole plate has a discardable steam-generating chamber preferably composed of sheet-metal foil or thin metal sheet lined with polytetrafluoroethylene and formed with an inlet for receiving water to be evaporated and an outlet for discharging steam flush with the sole plate, the outlet extending through an opening thereof. The steam-generating chamber has a surface substantially in face-to-face contact with a heat-transferring surface of the heating element and is pressed thereagainst with elastic deformation of the steam chamber via suitable means.

14 Claims, 10 Drawing Figures

FIG. 6
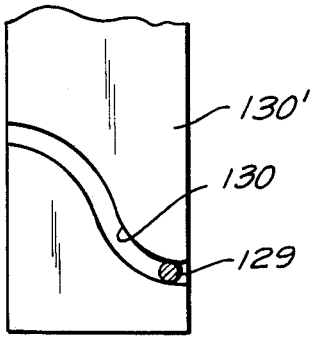
FIG. 9
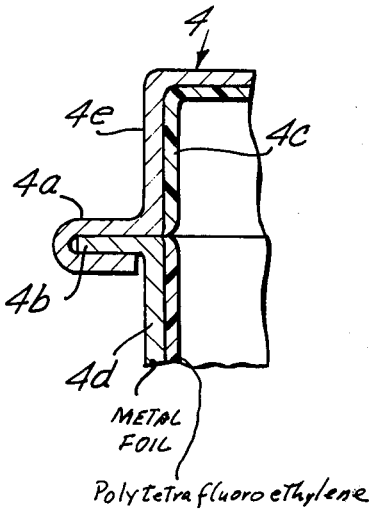
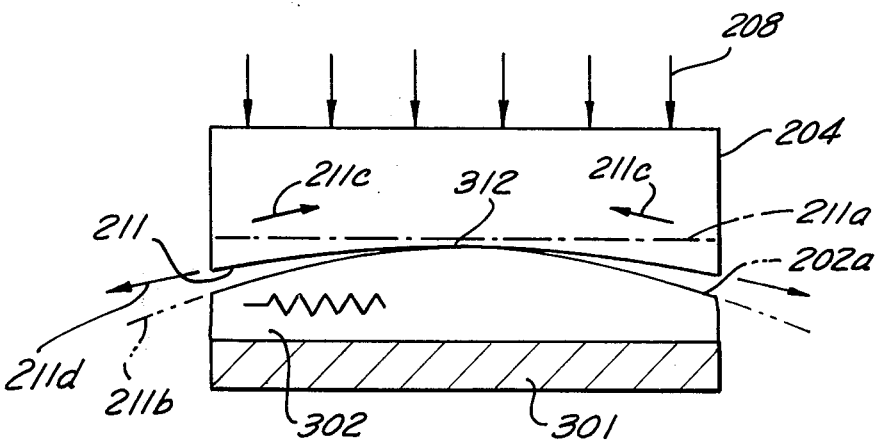
FIG. 10

FIG. 7
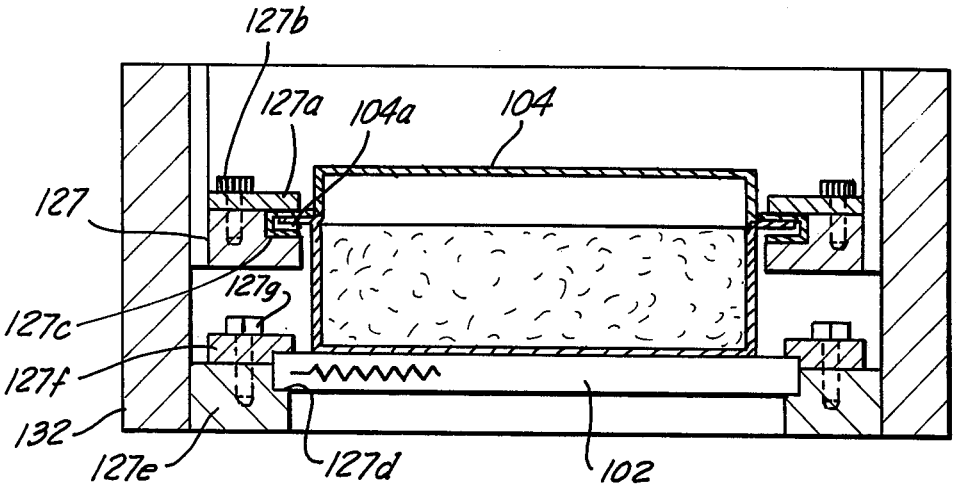
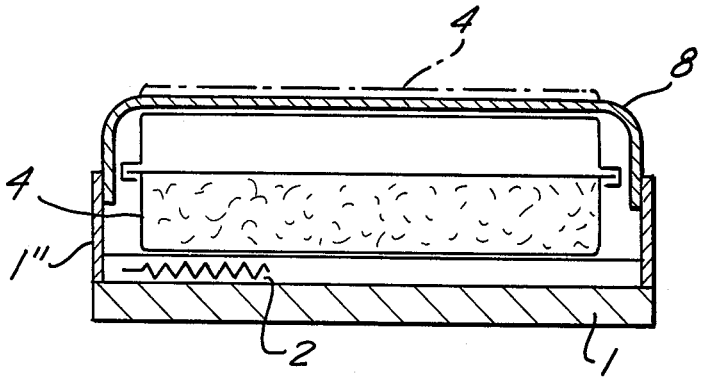
FIG. 8

STEAM IRON

FIELD OF THE INVENTION

The present invention relates to a so-called steam iron and, more particularly, to a hand-held iron adapted to press garments or other fabric material and having an electrically heated sole plate, a water container and a steam-generating chamber.

BACKGROUND OF THE INVENTION

In prior-art irons, water is heated and converted to steam by evaporation, the jets of steam emerging along the pressing face of the iron, e.g. through openings in a sole plate thereof.

In all appliances in which water is heated or evaporated, there is a formation of mineral deposits which can eventually obstruct the passages, outlets or other channels through which the steam or hot water passes. These mineral deposits are generally formed from water-insoluble calcium and magnesium salts, the residues of water evaporation or the like.

The deposits form predominantly at those locations at which the heat is applied to the water to be heated or evaporated and thus to the most strongly heated surfaces in contact with the water. In addition, the deposits form in the ducts, passages or tubes through which the steam is conducted.

In steam irons, this problem has necessitated, in a large number of cases, the use of distilled water from which such deposits will not form. Where other than distilled water is used, it is necessary to provide a demineralization or deposit-removal step after deposits have formed if the iron is to operate at its original efficiency or is to operate at all.

The use of distilled water is costly and a mechanical removal of the deposits cannot be achieved since access is not generally available to the chambers, ducts and passages in which the water is heated or converted to steam. As a consequence it has been necessary to use chemical demineralization techniques which are time consuming and not always effective. Furthermore, the demineralization agent is generally aggressive and corrosive and is detrimental to the health of the user. Finally, the disposal of the demineralizing agent constitutes a problem since it produces a strain on sewage-treatment facilities and the like.

If a demineralization is not carried out timely, the appliance fails and frequently cannot be repaired or freed from the deposit. In any case the deposition of mineral substances in heating chambers, ducts or channels reduces the useful life of the appliance by detrimentally affecting the seals and attacking the metallic parts thereof.

In a prior-art steam iron of the aforedescribed type, the evaporation chamber is provided with a flange which is set from below into the sole plate of the iron. The evaporation chamber or steam generator is thus readily removable for cleaning purposes and can, when cleaning is no longer possible, be replaced. This is also an expensive procedure and the device has been found to be disadvantageous in that deposits are found in the region of the steam passages as well as between the steam-generating chamber and the sole plate or member. These deposits cannot be eliminated by replacing the steam-generating chamber.

OBJECT OF THE INVENTION

It is the principal object of the present invention to provide a steam iron which avoids the aforementioned disadvantages and eliminates the problem of demineralization.

SUMMARY OF THE INVENTION

This object and others which will become apparent hereinafter are attained, in accordance with the present invention, by constituting the steam-generating chamber of thin sheet metal (e.g. extremely thin steel sheet or strip or metal foil) and forming it as a disposable container, the steam-generating chamber having a heat-transferring surface substantially in face-to-face relationship with a heat-producing surface of the heating element.

According to an important feature of the invention, the steam iron is provided with a stressing device for urging the heat-transfer surface of the discardable steam-generating chamber with elastic deformation against the heat-transfer surface of the heating element.

Any deposition of mineral matter takes place fully in the interior of the steam-generating chamber which can be discarded as a unit and preferably is provided unitarily (integrally) with a water inlet and a steam outlet opening at the sole plate of the steam iron. Instead of demineralizing the steam-generating chamber, the latter is completely replaced so that the remainder of the steam iron has a long useful life and has no parts which are affected by mineral deposits. The steam-generating chamber does not require demineralization and, being composed of foil or of the thinnest sheet metal, can be discarded as a unit at minimum cost. The wall thickness of the steam-generating chamber can be of the order of several mils.

To ensure an effective heat transfer between the heating element and the interior of the steam-generating chamber, it has been found to be advantageous to have the heat-receiving surface of the chamber in face-to-face contact with the heat-emitting surface of the heating element and substantially in coextensive relationship therewith. Substantially face-to-face contact or fluid contact between the two surfaces, according to the invention, means that the two surfaces are in contact with one another over the greater portion of their juxtaposed surface areas. The direct contact can, however, be interrupted at ribs or the like formed in the heat-receiving surface of the steam-generating chamber, the ribs being provided to add structural strength to the latter and increase the heat-exchange surface area in contact with the fluid therein. The contact surfaces can be flat, somewhat curved or even corrugated while achieving the face-to-face contact mentioned above.

Effective heat transfer is ensured by pressing the steam-generating chamber against the heat-emitting surface of the heating element such that the steam-generating chamber is at least partly deformed by the stressing means.

Since the heat-generating chamber is constituted of extremely thin sheet metal, the elastic deformation holds the heat-receiving surface of the chamber in the aforementioned face-to-face contact with the intrinsic elasticity or resiliency of the chamber walls.

The elastic deformation of the chamber can be so effected that the heat-receiving surface in the cold state is prestressed by the elestic deformation (i.e. pretensioned) with the direction of the pretensioning so arranged that the thermal expansion of this surface or the wall constituting the same at least partly compensates for the pretension applied in the cold state.

For example, the heat-emitting surface of the heating element can have an outwardly convex curvature while the heat-receiving surface of the chamber is concave in the direction of the heating element and has a larger radius of curvature when stressed in the cold state. During the elastic deformation, therefore, the heat-receiving surface is pressed against the heat-emitting surface to bring about the aforementioned pretension. When the heat is applied, however, at least part of this pretension is compensated by the thermal expansion of the heat-receiving surface which can more closely conform to the heat-emitting surface. However, one can also use a membrane-like stressing of the heat-receiving surface.

The formation of the heat-generating chamber of thin sheet metal is advantageous from two major points of view. Firstly, it is possible to form the steam-generating chamber as a disposable unit at a very low cost. Secondly, it is possible to ensure effective heat transfer by using the inherent deformability of the steam-generating chamber to bring about the surface-to-surface or face-to-face contact between the heat-emitting surface of the heating element and the heat-receiving surface of the chamber. Furthermore, the steam-generating chamber, which is relatively yieldable, is given significant stability because it is supported under stress between the heating element and the stressing means.

The heating element is preferably a planar heating plate disposed between the steam-generating chamber and the sole plate of the iron. The heating element can be used to provide the desired level of heat for the sole plate as well as to heat the contents of the steam-generating chamber. Alternatively, the heating element for the steam-generating chamber may be separate from the heating element used to heat the sole plate. When the heating element is a planar structure, the wall of the steam-generating chamber in contact therewith, i.e. the heat-receiving surface of this chamber, is likewise flat and smooth.

The heat-generating chamber is provided, according to a feature of the invention, with a pair of shell structures formed peripherally with respective flanges which can be seamed together along a rolled, crimped or folded seam. The shells may be composed, as indicated, as preshaped metal foil or extremely thin metal sheet or strip. To improve the heat transfer to the contents of the steam-generating chamber, the walls of the latter can be provided with inwardly projecting ribs, thereby increasing the effective surface area of the sheet metal in contact with the fluids within the chamber.

The ribs can subdivide the interior of the steam-generating chamber into a multiplicity of interconnected compartments which, in order to form dry steam, may contain sieve or filter elements or fluid-permeable heat-conducting packings of, for example, steel wool.

According to another feature of the invention, the interior of the steam-generating chamber is coated with a low-friction material capable of resisting deposition of mineral matter thereon, e.g. polytetrafluoroethylene or the like. The heat-exchange capacity of the device can be increased as indicated by the use of the metal-wool packing or by the use of metal turnings, chips or like packing materials.

By constituting the steam-generating chamber of thin sheet metal, I gain the important advantage in that the inclusion of a pressure-responsive warning device is possible at relatively low cost. Such a warning device, intended to indicate to the operator that there is an excessive build-up within the steam-generating chamber, can comprise a depressed portion of a wall of the steam-generating chamber which, upon the development of excessive pressure therein, snaps outwardly and can trigger a signal to alert the user or operate a switch to cut off the power supply to the steam iron.

According to another feature of the invention, the steam-generating chamber is formed in one piece with an angled portion which is turned downwardly and fixed within a window in the sole plate and is provided with steam-outlet openings along this angled portion. In this case, any mineral deposition takes place exclusively within the body of the steam-generating chamber or in this angled portion or at the outlet openings and there is no other part of the steam iron which is contacted by steam or suffers the risk of mineralization.

The stressing means which elastically deforms the steam-generating chamber against the heating element can be constituted in different ways. For example, the steam-generating chamber can be removably mounted in the housing of the steam iron and pressed against the heating surface elastically by a removable portion of the steam-iron housing or the heating surface can be spring or cam biased against the chamber.

The housing can be provided with a water-metering device whereby water is metered from a container or reservoir within the steam iron in predetermined quantities, e.g. as droplets, for example in the manner described in the aforementioned German published application. The outlet of the water-metering device can be readily connected to the inlet of the steam-generating chamber, e.g. by forming the latter outlet as a plug and the inlet of the steam-generating chamber as a socket receiving the aforementioned plug.

The heating element can be permanently mounted in the steam iron or can be removable with a housing portion thereof carrying the steam-generating chamber and from which the steam-generating chamber can be removed.

The steam-generating chamber can be pressed against the heating element by a lockable pressing plate which can engage the sole plate or the heating element and is connected therewith, e.g. pivotally or through other means. It is also possible to provide the sole plate, heating element and pressing means as a unit which is removable from the iron or to constitute the sole plate, heating element and steam-generating chamber as a unit which is removable from the iron and which stresses the steam-generating chamber when the unit is reinserted. In all of these cases, there is little difficulty in readily connecting the inlet opening of the steam-generating chamber and the outlet of the water-metering device.

It has been found to be especially simple to mount the steam-generating chamber so as to facilitate its replacement by providing a slide which is removably fitted into and forms part of the steam-generator housing, the slide being provided with at least one frame which engages the steam-generating chamber and can be guided by a cam-follower pin so as to stress the steam-generating chamber when the slide is inserted and relieve the chamber when the slide is withdrawn.

By actuating the slide, the frame can be spring biased to relieve the steam-generating chamber or the cam along which the cam-follower pins are guided can be a slave cam of suitable shape to ensure destressing. In order to remove the steam-generating chamber, therefore, it is only necessary to withdraw the slide and lift the chamber from the pivotal frame thereof. The swinging movement of this frame enables the aforementioned angled portion of the chamber to withdraw from the window in the sole plate and clear the latter. When the slide is pushed back into the remainder of the steam-iron housing, the guide pins and cam surfaces press the steam-generating chamber against the heating element and simultaneously fit the inlet of the chamber into the outlet of the metering device.

The frame can be provided in two parts, e.g. upper and lower frame members, the lower frame members carrying the heating element if desired while the upper frame member carries the steam-generating chamber.

The system described above has numerous advantages, especially in that it enables the steam iron to be operated free from danger of mineralization of from any detrimental affects of mineralization since the steam-generating chamber can be simply discarded in case of excessive mineral deposits or evaporation residues. The replacement is a brief operation with a minimum of manipulative steps and the replacement steam-generating chamber is of low cost. Time consuming and dangerous chemical demineralization steps are completely eliminated and the useful life of the iron is increased since seals and metallic components are not adversely affected by either the mineralization or the use of corrosive demineralizing chemicals.

The replacement of the steam-generating chamber can be effected without tools and by an unskilled user since the steam-generating chamber has the configuration of a cassette and can be replaced just as easily as a cassette is replaced in a cassette recorder.

Surprisingly, the improved system has been found to give better utilization of the energy consumed by the heating element, presumably because of the effective heat transfer through the thin wall of the steam-generating chamber and below thermal inertia thereof.

BRIEF DESCRIPTION OF THE DRAWING

The above and other objects, features and advantages of the present invention will become more readily apparent from the following description, reference being made to the accompanying drawing in which:

FIG. 6 is an elevational view of a cam having a different configuration from that of FIGS. 4 and 5 for controlling the means for stressing the steam-generating chamber;

FIG. 7 is a transverse vertical section through a steam iron according to the invention illustrating other features thereof;

FIG. 8 is a transverse section through the portion of the steam iron shown in FIG. 1 indicating the relationship between the steam-generating chamber before the stress is applied and after the same is destressed;

FIG. 9 is a detail cross-sectional view, drawn to an enlarged scale, through the wall of the steam-generating chamber; and FIG. 10 is a diagram of the relationship between a heating element according to the invention and the steam-generating chamber as seen from a direction similar to that in which the unit of FIG. 8 is viewed.

SPECIFIC DESCRIPTION

Figure 1:
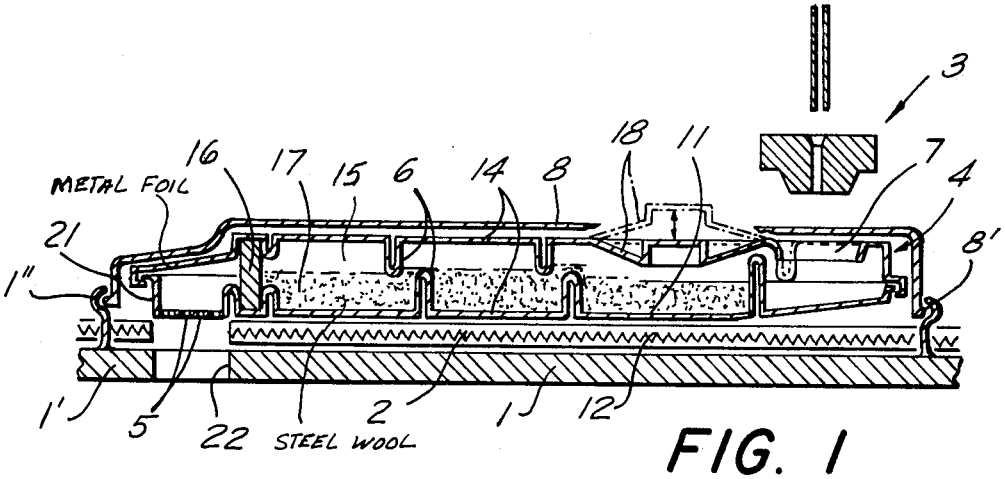
FIG. 1 is a vertical section through essential portions of a steam iron according to the invention, illustrated from the side and in diagrammatic form.

FIG. 1 shows the basic elements of a steam iron according to the invention, the steam iron comprising a sole plate 1 having a pressing surface 1' adapted to engage the fabric and provided substantially coextensively therewith with a flat electric heating element 2 which has been shown only diagrammatically, the electric resistance heating wire thereof being represented by an undulating line.

The heating element 2 is connected through the usual thermostat and electric iron switch to line current via an electric cord (not shown). The steam iron is also provided with a metering device 3 for feeding droplets of water from a water reservoir in the housing of the iron to the steam-generating chamber 4, the water reservoir and details of the metering device being omitted for clarity.

The steam-generating chamber 4 is heated by the heating element 2 and thus vaporizes the water, the resulting steam passing out of the chamber through the outlet openings 5 in a downwardly-turned angled portion 21 of the steam-generating chamber.

As can be seen from FIG. 9, the steam-generating chamber 4 may consist of an upper shell **4*e* of, for example, aluminum foil and a lower shell 4*d* also of aluminum foil, the foil having a thickness of, say 10 to 15 mils. The two shells are joined by a seam formed by a rolled-pver flange 4*a* which receives the outwardly projecting flange 4*b*** of the lower shell.

The inner surfaces of the shells may be lined with polytetrafluoroethylene **4*c* to a thickness of, say, 1 mil. This lower-friction layer reduces the tendency for mineral deposits to form on the interior of the steam-generating chamber. The chamber 4 is thus formed with a pair of flanges which are seamed together to form a bead which extends all around the periphery thereof and may serve to anchor the steam-generating chamber 4** removably in the steam-iron housing.

The steam-generating chamber is removable and disposable and has a heat-receiving surface or floor 11 in substantially face-to-face contact with a heat-emitting surface 12 of the heating element 2. The contact between these surfaces is coextensive except in the regions at which ribs 6 rise from the floor of the steam-generating chamber. The ribs 6 serve to stiffen the chamber and to increase the heat exchange surface area between the fluids within the chamber and the heated wall 11 thereof.

Figure 2:
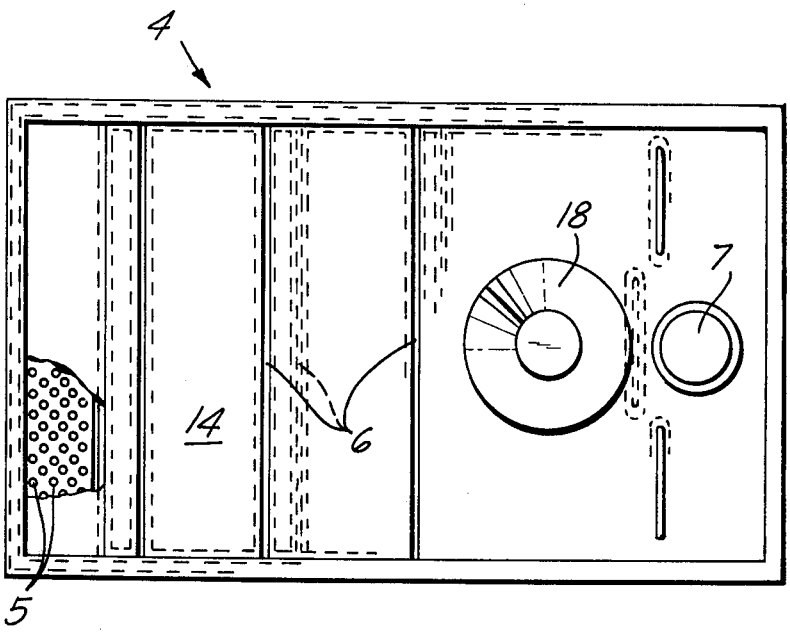
FIG. 2 is a top-plan view of the steam-generating chamber used in the structure of FIG. 1, partly broken away.
Figure 3:
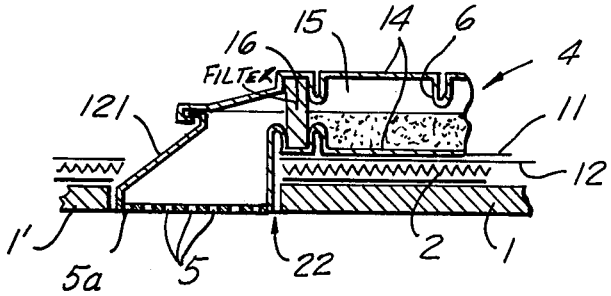
FIG. 3 is a fragmentary diagrammatic section showing the evaporation chamber having an angled portion received in a window of the sole plate so that its steam-discharge surface lies flush with the pressing surface of the sole plate.

In the embodiment of FIGS. 1–3, the heating element is a flat heating plate 2 which is disposed between the sole plate 1 and the steam-generating chamber 4. Of course it is also possible to provide a separate heating element for the sole plate and such a structure is described in connection with FIGS. 4 and 5. The heat-emitting surface 12 is here also continuous, flat and smooth.

The heat-receiving surface 11 is pressed, by elastic deformation of the steam-generating chamber 4, resiliently against the heat-emitting surface 12. To this end a stressing means is provided. In the embodiment of FIGS. 1 and 2, this stressing means is constituted by a pressure plate 8 which can be detachably locked to the sole plate 1. To this end, the sole plate may be provided with upstanding members 1" which form recesses adapted to engage outer ridges 8' of the pressure plate 8. The pressure plate 8 can thus be snapped into the members 1" (see FIG. 1).

In FIG. 8, I have shown the outline of the chamber 4 in dot-dash lines before this chamber is resiliently deformed by the plate 8. It will be seen that the chamber 4 is compressed against the heating element 2 when the plate 8 is snapped into place. The metering device 3 is simultaneously inserted in the inlet 7 of the steam-generating chamber if it is mounted directly on the pressing plate 8. The metering device in FIG. 1, however, has been shown in an exploded view, away from the plate 8 for convenience of illustration.

The upper and lower shell members in the system of FIGS. 1 and 2 are represented at 11 and both are provided with the ribs 6, the ribs of the upper member being staggered with respect to the ribs of the lower member and/or of reduced length so that a continuous clearance between the inlet 7 and the outlet 21, 5. The ribs 6 subdivide the interior fo the steam-generating chamber into compartments 15 which, for improved heat transfer and more rapid evaporation of the water, can receive a packing of steel wool 17. This arrangement produces a dry steam. Toward the outlet side of the devide, a filter 16 can be provided to prevent contaminants from passing into the outlet 21.

The steam-generating chamber 4 is also provided, along its upper surface, with an inwardly pressed formation 18 which normally lies within the steam-generating chamber as is shown in solid lines in FIG. 1. If the pressure within the steam-generating chamber becomes excessive, however, this formation 18 pops out as represented in dot-dash lines in FIG. 1 and can operate a warning signal or cut off the energization of the steam iron. Such a pressure build up within the chamber 4 can arise when mineral deposits have obstructed the outlet openings of this chamber. Thus, when the formation 18 pops out, the entire chamber can be removed, discarded and replaced.

In the embodiment illustrated in FIGS. 1 and 2, the angled portion 21 of the steam-generating chamber is aligned with a window 22 in the sole plate 1 of the steam iron. However, in the embodiment of FIG. 3, the angled portion 21 is shown to fit within the window 22 and the surface 5*a* of this angle portion which is provided with the outlets 5, lies flush with the pressing surface 1' of the sole plate.

Figure 4:
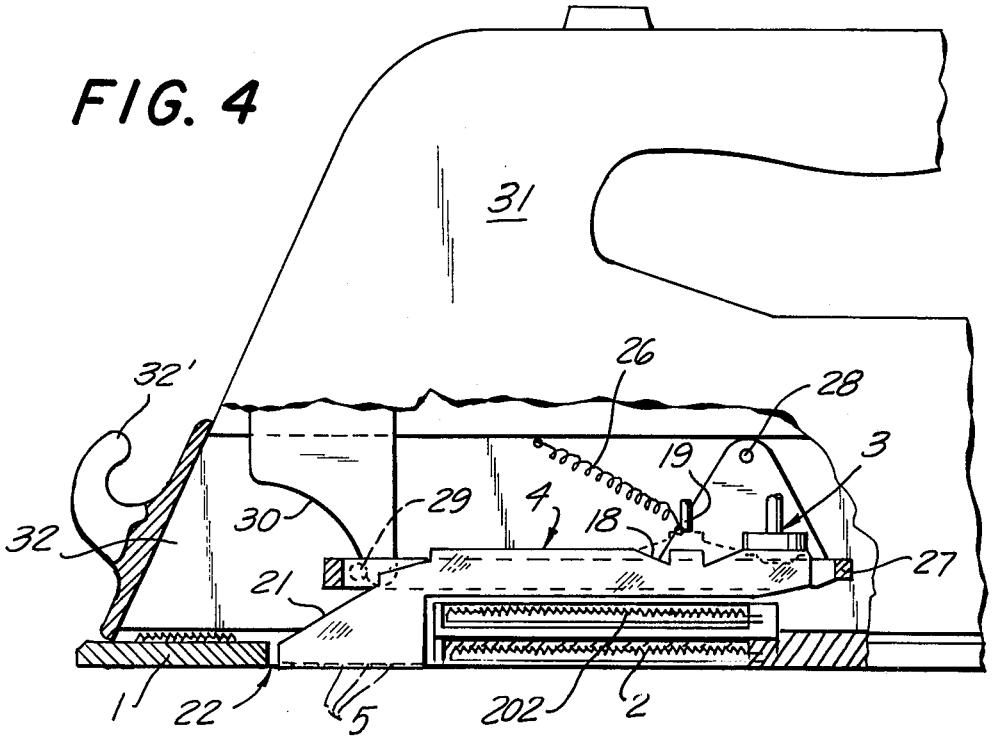
FIG. 4 is a view similar to FIG. 3 of the front end of a steam iron according to the invention, parts being broken away while other parts are shown in diagrammatic form.
Figure 5:
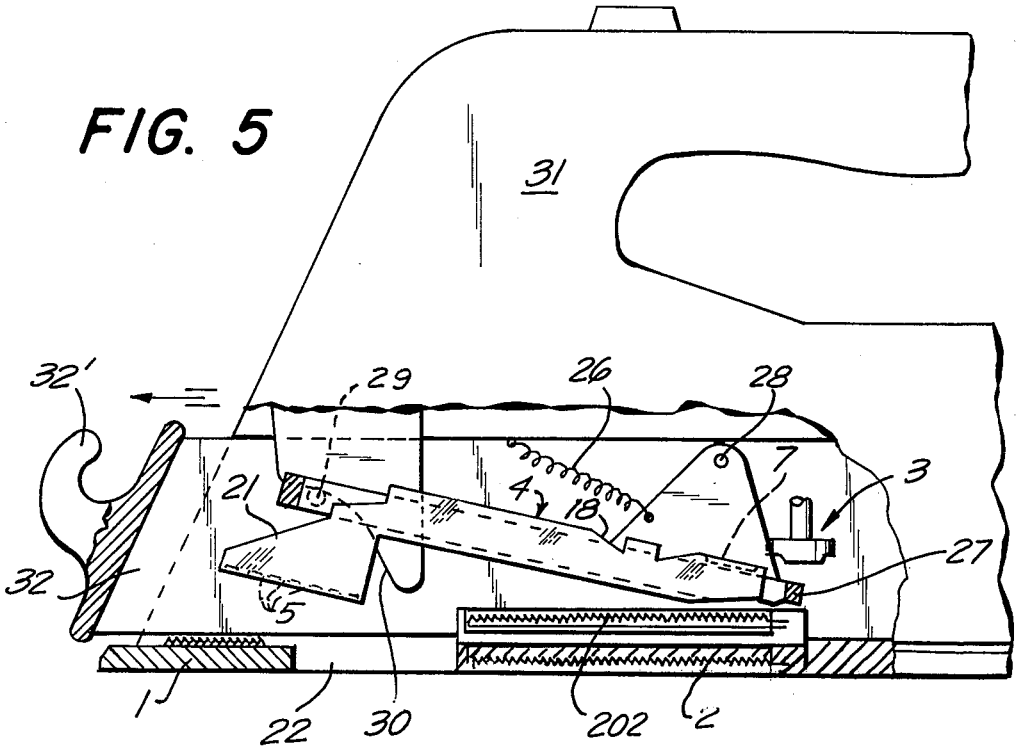
FIG. 5 is a view of the device of FIG. 4 in a different operating position.

The embodiment illustrated in FIGS. 4 and 5 permits an exceptionally rapid replacement of the steam-generating chamber. The housing 31 of the steam iron is here provided with a chamber slide 32 which can be moved into and out of the iron (see the arrow in FIG. 5) and is provided with a frame 27 pivoted at 28 to the lateral walls of this slide. The iron is formed with a sole plate 1 and a heating element adapted to heat the sole plate as previously described.

However, for heating the water in the steam-generating chamber 4, a separate heating element 202 is provided, the latter being either mounted on the housing 31 or the slide 32.

The slide 32 has a handle 32' which can be engaged by the operator to draw the slide out of the iron.

The steam-generating chamber 4 is received in the frame 27 which is provided with a pair of guide pins (only one of which is shown at 29) adapted to engage a camming surface 30 mounted on the housing 31. A spring 26 urges the frame 27 in a clockwise sense about the pivots 28. Thus the spring 26 also urges the pins 29 against the camming surface 30.

In the inserted position of the slide 32, the inlet 7 of the steam-generating chamber 4 is pressed against the metering device 3. The angled outlet portion 21 of the steam-generating chamber 4 projects through the window 22 in the sole plate 1 as described in connection with FIG. 3. I have also diagrammatically illustrated in FIGS. 4 and 5, a warning device, e.g. a switch 19, connected to an alarm or a cut off for the steam iron and which is aligned with the formation 18, to be actuated thereby when this formation pops out of the steam-generating chamber upon the development of excess pressure.

Upon withdrawal of the slide 32, the pins 29 are guided upwardly and forwardly along the surface 30 under the action of spring 26 so that the frame 27 swings upwardly and hence releases the inlet 7 from the metering device 3 while withdrawing the outlet angled portion 21 from the window 22. Upon full withdrawal of the slide 32, the disposable steam-generating chamber 4 can be discarded and replaced by another such chamber. When the slide 32 is then reinserted into the iron, the cam surface 30 swings the frame 27 downwardly to fit the metering device 3 into the inlet 7 and the outlet 21 into the window 22 while pressing the steam-generating chamber against the heating element 202.

As can be seen from FIG. 7, the frame structure received in the slider 132 can carry an upper frame 127 and a lower frame 127*e* the latter having a seat 127*d* for a heating element 102 which is equivalent to the heating element 202 described in connection with FIGS. 4 and 5. The heating element 102 is held in place by bars 127*f* and releasably fixed by knurled-head screws 127*g*.

The upper frame 127, which is swingably mounted on the slide 132 as described for the frame 27, has a sleeve 127*c* in which the bead 104*a* of the steam-generating chamber 104 is received. The bead 104*a* is engaged by the bars 127*a*, locked via the knurled-head screws 127*b*.

The upper and lower frames thus permit the upper frame to act as the pressure member which carries the guide pins 29 engageable with the cam 30. Of course, instead of guide pins, projections, abutment surfaces or the like can be formed on the frame 27, 127. When springs 26 are not used, the guide pins, e.g. as shown at 129 in FIG. 6, can be displaced along a groove 130 of a slave cam 130' depending from the housing 131 of the steam iron.

The replacement of the steam-generating chamber is simplified in the systems of FIGS. 4 – 7 in that the steam-generating chambers automatically swung upwardly as the slide is withdrawn so that it can be readily removed by a simple loosening of the screws 127*b*. Of course, when the slide is reinserted into the iron, it presses the chamber 104 against heating element 102.

FIG. 10 shows an embodiment of the invention in which the thin sheet metal steam-generating chamber 204 is juxtaposed with the heating element 302 having a curved surface (heat-emitting surface 312). In this embodiment, the steam-generating chamber 204 origically has a heat-receiving surface 211 which is under pretension in the direction of arrows 211*c* when this chamber is elastically deformed by pressure as represented by the arrows 208. Originally, however, the surface 211 can be flat or only slightly concave as represented by the dot-dash lines 211*a*. When heating commences, however, the thermal expansion is effective in the direction of arrows 211*a* so that it partly relieves the pretension applied at 211*c* and enables the surface 211 to swing down toward the position shown by the double dot-dash lines 211*b* and fully conform to the surface 312 of the heating element 302. The sole plate is shown at 301 in this embodiment.

I claim:

1. A steam iron comprising a housing, a sole plate on said housing having a pressing surface, a heating element in said housing, a discardable steam-generating chamber received in said housing and heated by said element, said element having a heat-emitting surface juxtaposed with said steam-generating chamber, said steam-generating chamber being composed of shells of thin metallic sheet secured together by beaded flanges and having a heat-receiving surface juxtaposed with said heating element, and stressing means elastically deforming said steam-generating chamber against said heating element to press said heat-receiving surface into face-to-face contact with said heat-emitting surface.

2. The steam iron defined in claim 1 wherein said heat-receiving surface is pretensioned by said stressing means in a direction such that the heat from said element causes thermal expansion of said heat-receiving surface to at least partly compensate for said pretension.

3. The steam iron defined in claim 1 wherein said heating element is a planar heating plate disposed between said sole plate and said steam-generating chamber, said heat-receiving surface being flat and bearing upon said heating plate.

4. The steam iron defined in claim 1 wherein said shells are composed of metal foil.

5. The steam iron defined in claim 1 wherein said steam-generating chamber is removably fixed in said housing and elastically deformed by said heating element.

6. The steam iron defined in claim 1 wherein said stressing means includes a plate bearing upon said steam-generating chamber and releasably engaging said sole plate.

7. The steam iron defined in claim 1 wherein said steam-generating chamber is formed unitarily with a water inlet and a steam outlet, said steam outlet lying flush with the pressing surface of said sole plate.

8. A steam iron comprising a housing, a sole plate on said housing having a pressing surface, a heating element in said housing, a discardable steam-generating chamber received in said housing and heated by said element, said element having a heat-emitting surface juxtaposed with said steam-generating chamber, said steam-generating chamber being composed of thin metallic sheet and having a heat-receiving surface juxtaposed with said heating element, stressing means elastically deforming said steam-generating chamber against said heating element to press said heat-receiving surface into face-to-face contact with said heat-emitting surface, said steam-generating chamber being formed internally with a plurality of interconnected compartments, at least one of said compartments being formed with a filter.

9. The steam iron defined in claim 5 wherein said steam-generating chamber is provided with ribs defining said compartments between them.

10. A steam iron comprising a housing a sole plate on said housing having a pressing surface, a heating element in said housing, a discardable steam-generating chamber received in said housing and heated by said element, said element having a heat-emitting surface juxtaposed with said steam-generating chamber, said steam-generating chamber being composed of thin metallic sheet and having a heat-receiving surface juxtaposed with said heating element, stressing means elastically deforming said steam-generating chamber against said heating element to press said heat-receiving surface into face-to-face contact with said heat-emitting surface, said steam-generating chamber being internally lined with polytetrafluoroethylene.

11. A steam iron comprising a housing, a sole plate on said housing having a pressing surface, a heating element in said housing, a discardable steam-generating chamber received in said housing and heated by said element, said element having a heat-emitting surface juxtaposed with said steam-generating chamber, said steam-generating chamber being composed of thin metallic sheet and having a heat-receiving surface juxtaposed with said heating element, stressing means elastically deforming said steam-generating chamber against said heating element to press said heat-receiving surface into face-to-face contact with said heat-emitting surface, said steam-generating chamber being formed with an inwardly pressed formation adapted to snap out upon the development of an excess pressure in said chamber, said steam iron being provided with means actuatable by said formation.

12. A steam iron comprising a housing, a sole plate on said housing having a pressing surface, a heating element in said housing, a discardable steam-generating chamber received in said housing and heated by said element, said element having a heat-emitting surface juxtaposed with said steam-generating chamber, said steam-generating chamber being composed of thin metallic sheet and having a heat-receiving surface juxtaposed with said heating element, stressing means elastically deforming said steam-generating chamber against said heating element to press said heat-receiving surface into face-to-face contact with said heat-emitting surface, said steam-generating chamber being formed integrally with an angled portion, said sole plate being provided with a window receiving said angled portion.

13. A steam iron comprising a housing, a sole plate on said housing having a pressing surface, a heating element in said housing, a discardable steam-generating chamber received in said housing and heated by said element, said element having a heat-emitting surface juxtaposed with said steam-generating chamber, said steam-generating chamber being composed of thin metallic sheet and having a heat-receiving surface juxtaposed with said heating element, stressing means elastically deforming said steam-generating chamber against said heating element to press said heat-receiving surface into face-to-face contact with said heat-emitting surface, a slide removably received in said housing and carrying a pivotal frame, said steam-generating chamber being mounted on said frema and having an inlet for water, said housing being provided with a metering device fitting in said inlet upon swinging of said frame into an operative position, said steam iron further comprising cam means for swinging said frame into saie operative position upon insertion of said slide in said housing.

14. The steam iron defined in claim 13 wherein said frame comprises upper and lower frame members, the upper frame member carrying said steam-generating chamber and being provided with control pins engageable with said cam means whereby said steam-generating chamber is pressed against said heating element.

* * * * *